US005974737A

United States Patent [19]

Barros et al.

[11] Patent Number: 5,974,737

[45] Date of Patent: Nov. 2, 1999

[54] SELF-OPENING ENTRY DEVICE FOR A CONTROLLED ACCESS AREA

[75] Inventors: José Barros, Mandres Les Roses; Claude Putteman, Le Bar sur Loup, both of France

[73] Assignee: CSEE Transport, Les Ulis cedex, France

[21] Appl. No.: 09/077,924

[22] PCT Filed: Dec. 3, 1996

[86] PCT No.: PCT/FR96/01923

§ 371 Date: Jun. 5, 1998

§ 102(e) Date: Jun. 5, 1998

[87] PCT Pub. No.: WO97/21898

PCT Pub. Date: Jun. 19, 1997

[30] Foreign Application Priority Data

Dec. 8, 1995 [FR] France ..... 95/14819

[51] Int. Cl.[6] ..... E05C 7/06

[52] U.S. Cl. ..... 49/117; 49/35; 49/360; 49/116

[58] Field of Search ..... 49/116, 117, 118, 49/119, 120, 360, 35

[56] References Cited

U.S. PATENT DOCUMENTS

| | | | |
|---|---|---|---|
| 1,314,206 | 8/1919 | Oster | 49/117 |
| 1,643,454 | 9/1927 | Hynes . | |
| 2,318,090 | 5/1943 | McCormick | 49/118 |
| 3,742,647 | 7/1973 | Tomita | 49/35 |
| 4,423,799 | 1/1984 | Glaser et al. | 49/116 X |
| 4,947,964 | 8/1990 | Husmann | 49/118 X |
| 5,538,106 | 7/1996 | McHugh et al. | 49/120 X |

FOREIGN PATENT DOCUMENTS

| | | |
|---|---|---|
| 2 694 648 A1 | 2/1994 | France . |

*Primary Examiner*—Jerry Redman
*Attorney, Agent, or Firm*—Lydon & Brown, LLP

[57] ABSTRACT

A self-opening and self-closing device enabling entry into a controlled access area includes a gate with two laterally retractable panels that may be opened by inserting a ticket or access card into a control mechanism. Each of the panels is controlled by a respective motor operated by the control mechanism. Each panel is secured to at least two runner members that are each operated by a roller secured to a link arm. The link arms are rotationally interconnected and rotated by the respective motor. Simultaneous rotation of the arms in opposite directions moves the two panels together (or apart) and thus closes (or opens) the entry device by moving each panel into a position in which it is locked by the respective arm in the horizontal position.

9 Claims, 2 Drawing Sheets

SELF-OPENING ENTRY DEVICE FOR A CONTROLLED ACCESS AREA

TECHNICAL FIELD

The present invention relates to automatic devices enabling entry into controlled or restricted access areas such as public transport networks, and relates in particular to an automatic opening and closing entry device for such areas.

BACKGROUND

A common way for controlling users entries into a public transport network such as metropolitan or regional rail system consists in installing entry devices whose opening is activated by the user through the insertion of a ticket or access card into a control mechanism.

Currently, there are two types of entry devices. The first type is a three-arm turnstile whose rotation by 120°, which allows only one person to get through, is activated by the insertion of a ticket into the control mechanism. The major drawback of such a device is that users who want to commit fraud can easily step it over.

To overcome this drawback, a second type of entry device has been installed for controlling users, either as a stand-alone device, or along with the three-arm turnstile. This is a quite high one-panel or two-panel gate, whose automatic opening activated by the insertion of the ticket into the control mechanism is controlled by an electric or pneumatic system. Such devices present a number of drawbacks. First, existing control systems require quite a long time to run their cycle and activate the opening (approximately 0.5 to 0.7 sec.), and thus require that the ticket control mechanism be located at a distance from the automatic door, what reduces the users flow. Once activated, the opening is abrupt. As a result, the system is noisy and subjected, mainly at the end of the opening cycle, to vibrations that reduce its reliability. Moreover, a high power is required, what makes the system expensive. At last, since the user always faces a closed door before its opening, such devices may cause a very unpleasant feeling of confinement to the user.

The system disclosed by the patent U.S. Pat. No. 1,643,454 relates to a garage door activated by a motor driven crank. A roller interdependent with the crank runs into a slide interdependent with the door, thus transforming the crank rotation motion into the door translation. This way, half a turn of the crank enables to switch from the open position to the closed and locked position since the crank is stopped in a position slightly below a horizontal level. This system, that can be profitably used for automatic gate opening and closing, has however the drawback that driving and locking the door by only one crank requires a heavy door and/or rail guiding on the floor or a long recess housing since the opening or closing effort during acceleration and deceleration phases, and especially the effort for forcing the entry not lined up with the rod, applies on the guiding device a high torque that may cause the failure of the mechanism. Moreover, such a system does not provide for automatic and fast opening of the gate in case of an accidental power cut.

SUMMARY OF THE INVENTION

This is why the object of the invention is to provide an automatic opening and closing entry device that overcomes the above-mentioned drawbacks.

This object is reached through the entry device of the invention, the type of which comprises a gate with two laterally retractable sliding panels, each panel being interdependent with at least two slide parts each actuated by a roller interdependent with a crank, the cranks being linked each other in their rotation driven by a motor associated with the panel, the starting up of which is activated by the control mechanism of a ticket inserted by a user, the simultaneous rotation of cranks in opposite directions tending to move away (or closer) the two panels and thus to produce the opening (or closing) of the entry device.

According to a feature of the invention, an inrush current clutch located between the motor and the shaft of one of the cranks enables to disengage the latter so that a release mechanism integrated into the crank rotation gearing will operate so as to enable automatic opening of each panel.

According to another feature of the invention, when the entry device is idle, each crank is located halfway between the opening and the closing positions of the entry device so that the latter be half-open, what prevents users from having a confinement feeling.

BRIEF DESCRIPTION OF THE DRAWINGS

The objects, features and other characteristics of the invention will become more apparent from the following description with reference to the accompanying drawings in which.

DETAILED DESCRIPTION OF THE INVENTION

Figure 1:
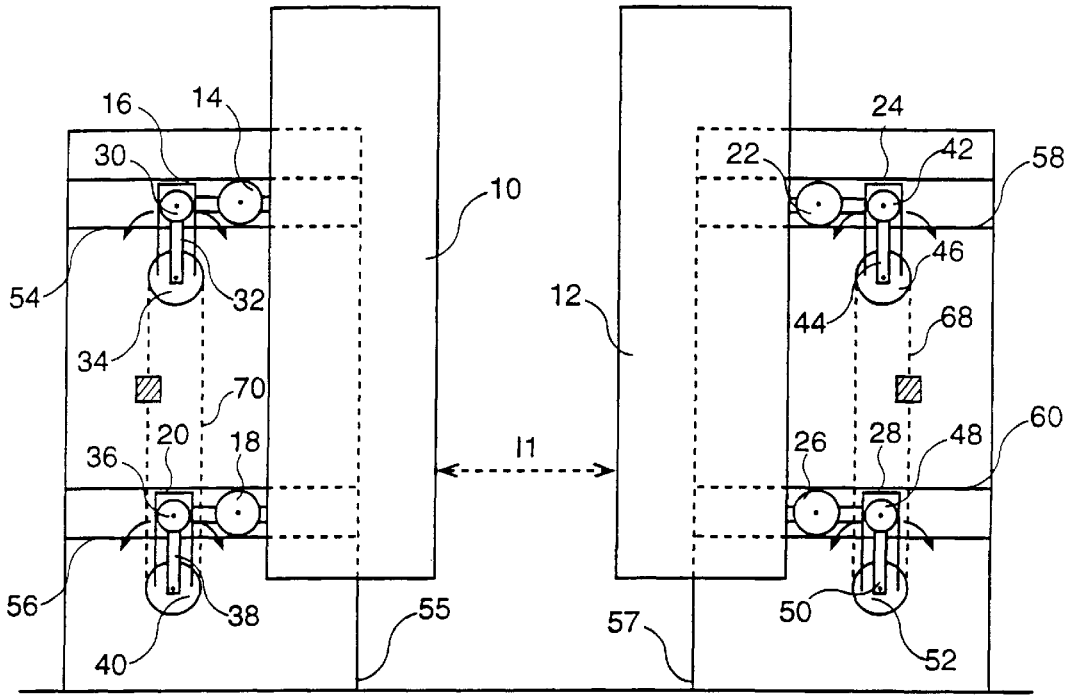
FIG. 1 shows the entry device according to a preferred embodiment of the invention, in its idle position.
Figure 2:
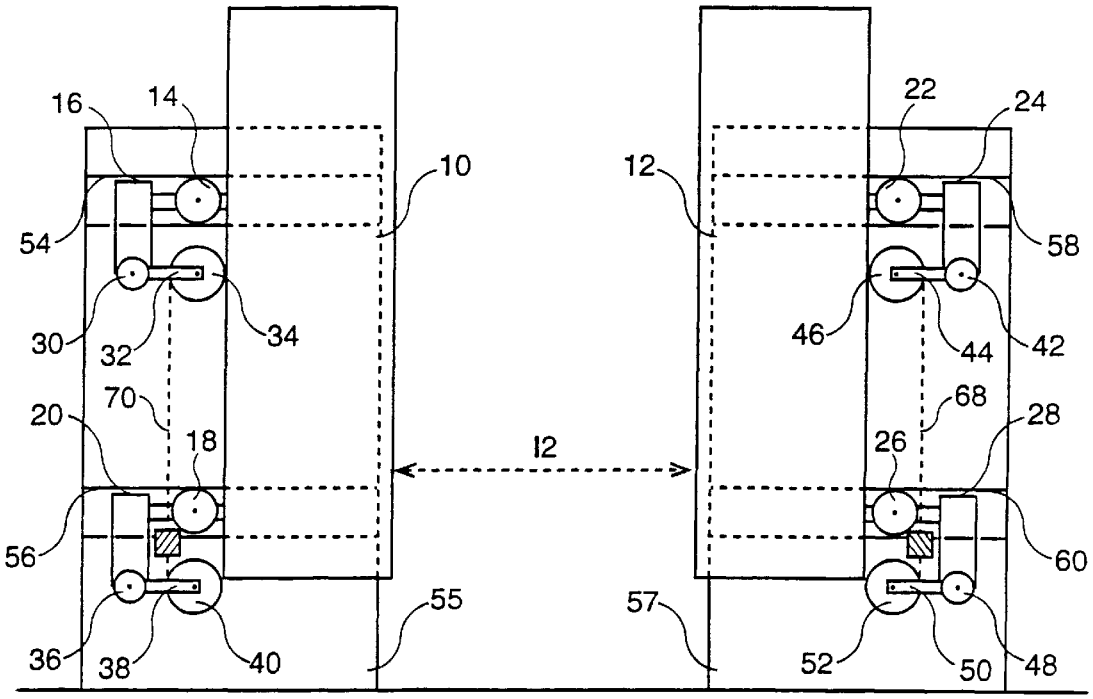
FIG. 2 shows the same entry device in its opening position.
Figure 3:
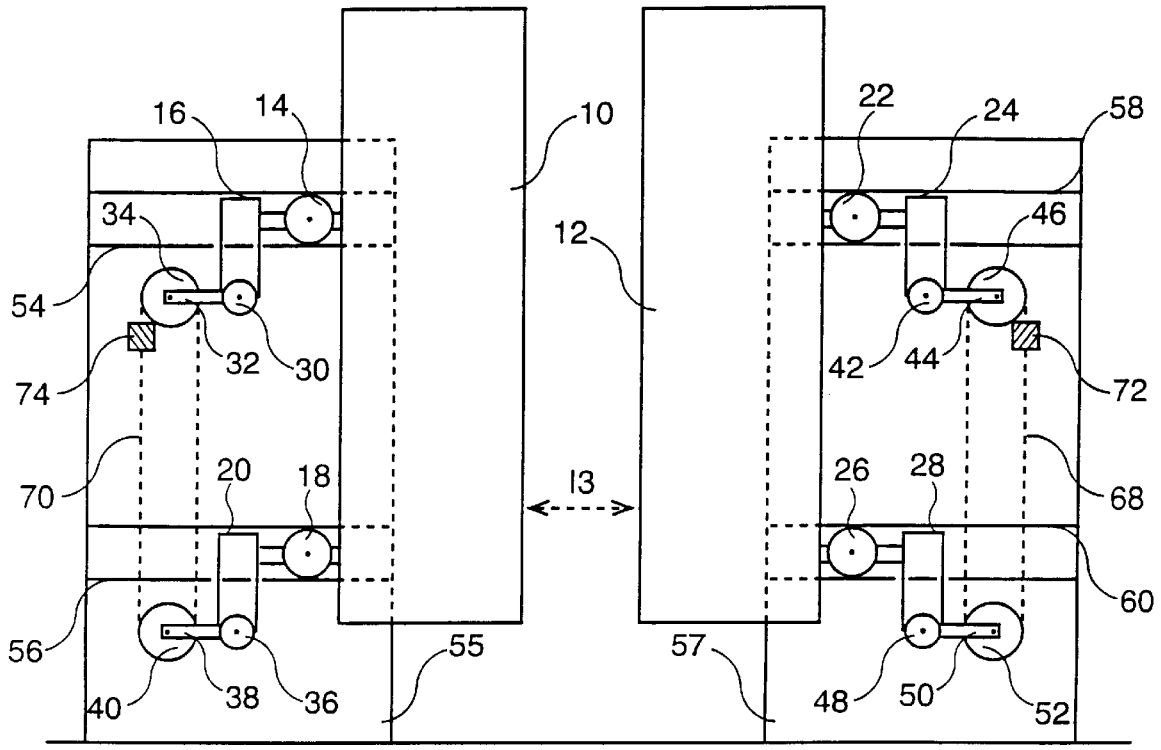
FIG. 3 shows the same entry device in its closing position.

According to a preferred embodiment, the entry device according to the invention shown diagrammatically on FIGS. 1, 2, and 3, comprises a gate made up of two laterally retractable sliding panels 10 and 12. Each panel comprises at least two slide parts, the rollers associated with each slide part and wheels for the translation motion of the panel. This way, the left panel 10 comprises a slide part 16, its roller 30 and a wheel 14 at the upper part, and a slide part 20, its roller 36 and a wheel 18 at the lower part. Similarly, the right panel 12 comprises a slide part 24, its roller 42 and a wheel 22 at the upper part, and a slide part 28, its roller 48 and a wheel 26 at the lower part.

Inside each slide part, that is between the two parallel walls of the components forming a slide, a cylindrical roller rotates freely around an axis located at the end of a crank the other end of which is interdependent with a driving shaft capable of driving the crank into a rotational motion. This way, inside the slide part 16 is located the roller 30 interdependent with the crank 32 driven in rotation by the shaft 34. Inside the slide part 20 is located the roller 36 interdependent with the crank 38 driven in rotation by the shaft 40. Inside the slide part 24 is located the roller 42 interdependent with the crank 44 driven in rotation by the shaft 46. At last, inside the slide part 28 is located the roller 48 interdependent with the crank 50 driven in rotation by the shaft 52.

The entry device according to the present invention shown diagrammatically on FIG. 1 is in idle position, namely at a position of rest, awaiting the insertion of a ticket into a control mechanism.

In the idle situation of FIG. 1, the cranks 32, 38, 44, and 50 are vertical and the rollers 30, 36, 42, and 48 are at their upper position inside the parts 16, 20, 24, and 28. Actually, the entry device has an intermediary position, that is it is neither open nor closed. This way, in the embodiment of FIG. 1, the gap 11 between the two panels is 30 cm. The purpose of this feature is to prevent incoming users from having a confinement feeling, what might occur if the gap were null.

When a user appears and inserts a ticket into a control mechanism, the device may respond in two ways. On FIG. 1, the arrows shown on both sides of rollers illustrate these two possibilities. If the entrance ticket is valid, the shafts 34, 40, 46, and 52 are driven in rotation anticlockwise (left arrows) for shafts 34 and 40, and clockwise (right arrows) for shafts 46 and 52. The two panels move away from each other and provide an opening of the entry device as shown on FIG. 2. During this operation, the rollers 30, 36, 42, and 48 have reached their lowest position inside their respective slide parts 16, 20, 24, and 28, while driving slide parts 16 and 20 to the left and slide parts 24 and 28 to the right.

During the opening motion, each panel slides into its own plane and is guided and supported by the wheels 14, 18 (for panel 10) and 22, 26 (for panel 12). The wheels are guided throughout the motion by guides comprising guiding walls. This way, the wheels 14 and 18 run respectively into the guides 54 and 56 interdependent with a casing 55, and the wheels 22 and 26 run respectively into the guides 58 and 60 interdependent with a casing 57. It is worth noting that other mechanisms could be used for panel sliding, such as ball or pads mechanisms. For example, the panels could slide into grooves made on the floor, and/or ball bearings could be secured under the panels to facilitate this sliding.

In the opening position of the entry device as shown on FIG. 2, and with cranks having a length of 10 cm, the gap 12 between the two panels is about 50 cm, thus enabling a user to get through, whatever its build.

The second case occurs when the user has inserted a non valid ticket into the control mechanism. In such a case, the entry device switches to the closing position shown on FIG. 3. To this end, the shafts 34, 40, 46, and 52 are driven in rotation clockwise for shafts 34 and 40, and anticlockwise for shafts 46 and 52. During this operation, the rollers 30, 36, 42, and 48 have reached their lowest position while causing slide parts 16, 20 on the one hand and 24, 28 on the other hand to move closer to each other, and thus both panels to get also closer to each other. In this position, the gap 13 between the panels is reduced to 10 cm, thus preventing anyone from getting through.

It should be noted that gaps 11, 12, and 13 between the panels in respective idle, opening, and closing positions depend on the rotation range of cranks driven by the driving shafts, and on their length. If, in the embodiment shown by FIGS. 1, 2, and 3, the crank length is increased by 5 cm, the idle position gap 11 remains unchanged at 30 cm, while the opening position gap 12 changes to 60 cm whereas the closing position gap 13 changes to 0 (panels touch).

On the other hand, these gaps can be changed by adjusting the angular shift of cranks. While keeping the cranks 32, 38, 44, and 50 vertical in idle position, in the closing position of panels 10 and 12 they must be at least horizontal or even slightly below a horizontal plane so as to provide a locking feature that prevents forced opening of the panels.

Furthermore, it is possible to use different motor speeds for opening and closing, so that the opening speed of panels be different from their closing speed.

FIGS. 1, 2, and 3 show a preferred embodiment wherein the cranks are horizontal in opening or closing positions. In fact, in this device, a rotation motion of driving shafts is transformed into a sinusoidal linear motion of slide parts. As a result, when the crank reaches the horizontal position at the end of the opening or closing motion, the speed passed on to the slide part, and thus to the panel, is null. This null speed prevents the abrupt stopping of the gate at the end of stroke noted with prior art devices.

Figure 4:
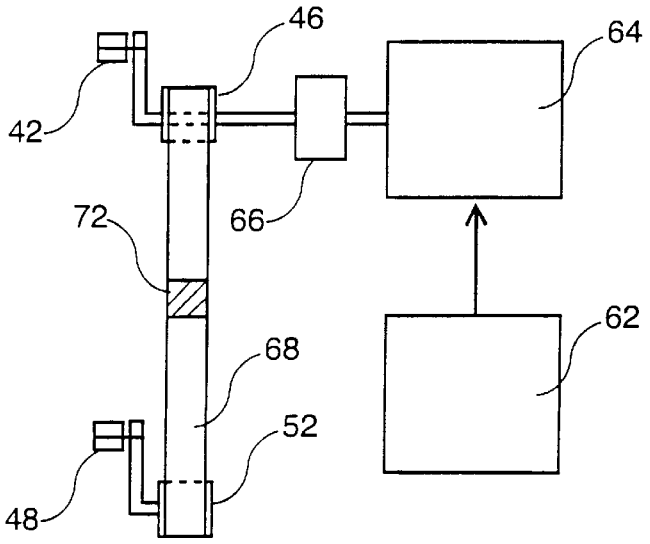
FIG. 4 is a diagrammatic representation of the control system of the device according to the invention.

FIG. 4 diagrammatically shows the control system of rollers 42 and 48. This system comprises a ticket control mechanism 62 that controls the operation of a motor 64. The latter controls the rotation of the shaft 46 through an inrush current clutch 66. The driving shaft 46 is linked to the shaft 52 by means of a belt 68. Similarly, the motion of the shaft 34 is passed to the shaft 40 by means of a belt 70 (see FIGS. 1, 2, and 3). It is worth noting that the belts could be replaced with any other motion transmission system such as a chain or a cable or any other mechanism, including a rod mechanism having preferably a rod rotation angle lower than 180°.

In a preferred embodiment, each of the two belts 68 or 70 is respectively provided with a counterweight 72 or 74 that is located at the lower position when the gate is open (see FIG. 2) and at the upper position when the gate is closed (see FIG. 3). When a power cut occurs, since the inrush current clutch 66 is no longer fed, the latter is then disengaged. As a result, the shafts are no longer driven and the two counterweights go down to their lower position, driving the belt that rotates the driving shafts of panels to lead the latter in the position shown on FIG. 3, that is in the opening position.

Although its shape is simple in the embodiment shown on the figures, the roller 30, 36, 42, 48 can have a more elongated shape or can be made up of two parts located on both sides of the crank, without getting out of the scope of the invention.

According to another embodiment, the counterweight can be replaced with any other releasing mechanism, including a spring, one end of which is secured to the same point that the counterweight 72 or 74, the other end being fixed at the lower part of the casings 55 and 57 in order to actuate the belts 68 and 70 to enable an opening in case of a power cut. According to another embodiment, the counterweight can be replaced by one or a plurality of torsion springs mounted on the shafts 34, 40, 46, and 52, interdependent, on the one hand, with their respective cranks, and on the other hand with the casings 55 and 57. In case of power cut, their prestressed condition in the closed position of the panels will produce the rotation of the cranks up to the open position of panels.

Another benefit is given by the short opening or closing stroke of the device, due to the intermediary idle position. This opening operation, much faster than with existing systems (about 0.2 sec.) further enables to place safely the ticket control mechanism or any other access authorization means very close to the gate itself, and thus ensures a maximum user flow through the latter.

As seen above, the design of the device leads to a null speed of the panels at the end of stroke. Therefore, no specific effort is required from the motor for acceleration or deceleration phases. The driving torque required is thus relatively low and there is no need for a force limiter for user safety during the closing phase in case of a defect. On the other hand, the embodiment just described comprising at least two cranks has the distinctive feature of ensuring an absolute locking in the closing position, and thus a good fraud-proof capability, insofar as the efforts produced by opening attempts are passed on neither to the guiding devices nor to the driving mechanism.

We claim:

1. An automatic opening and closing entry device for a controlled access area, comprising a gate whose opening is activated by insertion of an entrance ticket into a control mechanism, said gate being composed of two laterally retractable sliding panels, each having a closed position and an open position, each panel being driven from its closed position to its open position and back to its closed position by a driving mechanism controlled by an associated motor whose starting up is triggered by said control mechanism, wherein each panel is operatively connected to at least two slide parts, with each slide part operated by a roller operatively connected to a rotatable crank, the rotatable cranks associated with one panel being linked with each other in their rotation and controlled by said motor, wherein simultaneous rotation of the rotatable cranks associated with one panel in a direction opposite to rotation of the rotatable cranks associated with the other panel moves the two panels either closer together or away from one another to cause closing or opening of the entry device, and wherein a return mechanism permanently exerts a force on said rotatable cranks tending to open said panels.

2. The device of claim 1, wherein said rotatable cranks are horizontal or slightly below a horizontal plane when said panels are in their closed position so as to prevent any effort tending to forcibly open said panels from being passed on to said driving mechanism.

3. The device of claim 1, wherein a single motor controls rotation of the two rotatable cranks operatively connected to the two rollers associated with each panel through a belt.

4. The device of claim 3, wherein the driving of the belts by said motor is carried out through an inrush current clutch, so that the action of said release mechanism automatically moves said panels to their open position when no electric current feeds said clutch.

5. The device of claim 1, wherein, when no entrance ticket has been inserted into the control mechanism, each panel is located halfway between its closed position and its open position in an intermediate position.

6. The device of claim 5, wherein a length of said cranks is 10 cm so that, if a gap between said panels in said intermediate position is 30 cm, a gap between said panels in the open position is 50 cm and a gap between said panels in the closed position is 10 cm.

7. The device of claim 1, wherein each rotatable crank rotates by 180° in one direction from an open position to a closed position, and rotates by 180° in the opposite direction from the closed position to the open position, and wherein the roller operatively connected to said rotatable crank runs along a semicircle to move from a furthest position away from the associated panel when the entry device is open to a closest position to the associated panel when the entry device is closed.

8. The device of claim 1, wherein each panel is operatively connected to two slide parts.

9. The device of claim 1, wherein said return mechanism includes a spring or a counterweight.

* * * * *